US006059613A

United States Patent [19]

Feher et al.

[11] Patent Number: 6,059,613

[45] Date of Patent: May 9, 2000

[54] PIVOTALLY LINKED ELECTRICAL CONNECTORS

[75] Inventors: Michael S. Feher, Steelton; Edward J. Howard, Millersburg, both of Pa.

[73] Assignee: The Whitaker Corporation, Wilmington, Del.

[21] Appl. No.: 09/036,364

[22] Filed: Mar. 6, 1998

[51] Int. Cl.[7] ..... H01R 9/22

[52] U.S. Cl. ..... 439/713; 439/590; 439/937

[58] Field of Search ..... 439/590, 594, 439/713, 717, 737, 937

[56] References Cited

U.S. PATENT DOCUMENTS

| | | | |
|---|---|---|---|
| 2,774,053 | 12/1956 | Seger | 439/590 |
| 4,715,119 | 12/1987 | Joosten | 29/858 |
| 4,766,521 | 8/1988 | Pelletier | 439/713 X |
| 5,380,222 | 1/1995 | Kobayashi | 439/590 |

*Primary Examiner*—Khiem Nguyen

[57] ABSTRACT

Electrical connectors include terminal blocks each having a ball at one end and a complementary socket at an opposite end. The terminal blocks may be linked together by coupling the balls in the sockets. Each coupled ball and socket provides a pivoting link between terminal blocks. A plurality of terminal blocks which are pivotally linked together may conform to the curved surface of an electric motor or other device.

12 Claims, 5 Drawing Sheets

PIVOTALLY LINKED ELECTRICAL CONNECTORS

FIELD OF THE INVENTION

The invention relates to electrical connectors which can be linked together to form a connector chain.

BACKGROUND OF THE INVENTION

A number of electrical devices such as motors and generators have wire windings which are wrapped around a core and mounted in a housing. The housing usually has a generally round shape that conforms to the generally round shape of the wire windings. These electrical devices may have one or more electrical connector blocks mounted on or in the housing to provide a junction between internal and external electrical wiring. When multiple electrical terminations must be made to the wire winding, it is impractical to use a single connector block having multiple terminals because the single connector block would be relatively long and would not conform to the shape of the round housing. Instead, multiple small connector blocks are used, but each of these must be handled and attached separately to the housing. There is a need to integrate multiple connector blocks into a unit which is compatible with a housing for a wire winding.

SUMMARY OF THE INVENTION

The invention is an electrical connector comprising a terminal block having a first end and a second end. The first end includes a ball which is disposed at an end of an arm. The second end includes a socket which is dimensioned complementary to the ball. A wall of the socket has a slot which can receive the arm of an identical terminal block when the ball of the identical terminal block is installed in the socket. The ball and the socket provide a pivoting link between terminal blocks whereby a plurality of terminal blocks may be pivotally linked together in a chain.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
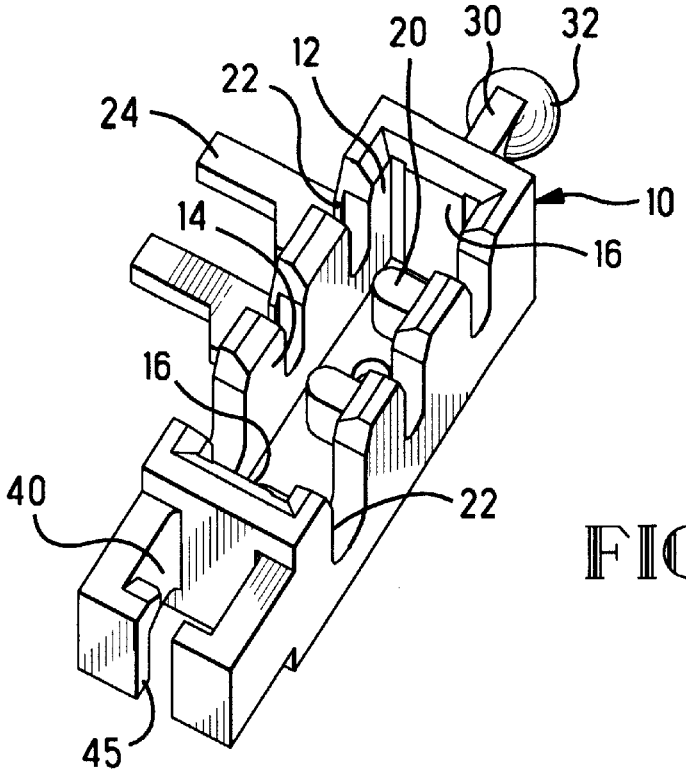
FIG. 1 is an isometric view of a terminal block for an electrical connector according to the invention.
Figure 2:
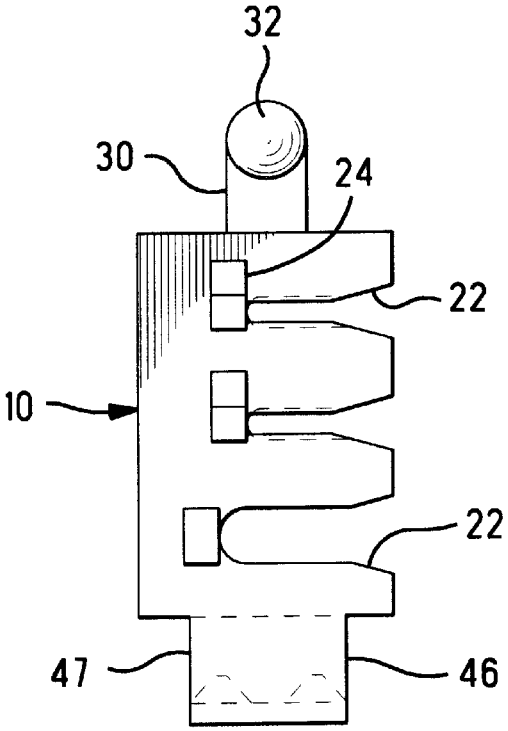
FIG. 2 is a side view of the terminal block.
Figure 3:
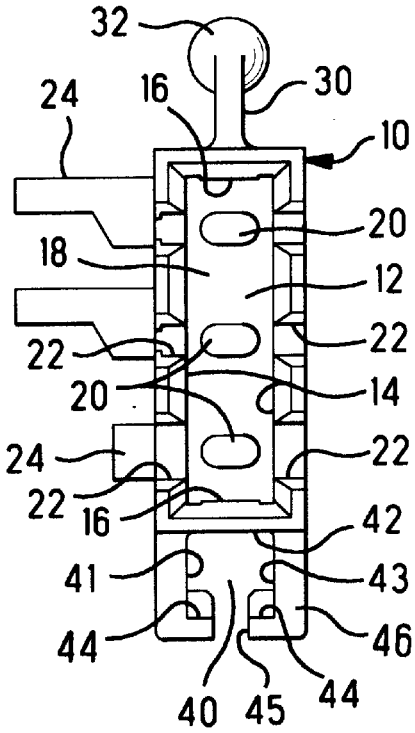
FIG. 3 is a top view of the terminal block.

As shown in FIGS. 1–3, an electrical connector according to the invention comprises a terminal block 10 in the form of a dielectric housing that is configured to hold one or more electrical terminals (not shown). The terminal block in the present example has a terminal-receiving cavity 12 which is bounded by side walls 14 and end walls 16. The side walls 14 have pairs of opposed slots 22 which permit wires to be inserted into the terminal block for insulation displacement termination in the terminals that are held in the cavity. The terminals may be specially configured insulation displacement terminals of a type that are manufactured and sold under the trademark Mag-Mate® by AMP Incorporated of Harrisburg, Pennsylvania. A floor 18 of the cavity is configured with three posts 20 which provide wire support during termination. Platforms 24 which extend from the terminal block are co-planar with bottoms of the slots 22. The platforms serve to support ends of terminated wires during excess wire trim processing.

A first end of the terminal block includes an arm 30 which extends outwardly from the end wall 16. An enlargement in the form of a ball 32 at a free end of the arm has a generally spherical shape. The ball 32 serves as a component of a mating ball and socket coupling.

A second end of the terminal block includes a socket 40 that is complementary to the ball 32. The socket is bounded by side walls 41, 42, 43, 44 and has an open top and an open bottom. The wall 44 has a slot 45 that extends through the entire the length of the wall between top edge 46 and bottom edge 47. The slot has a width that is dimensioned to receive the arm 30 but which is narrower than the ball 32.

Figure 4:
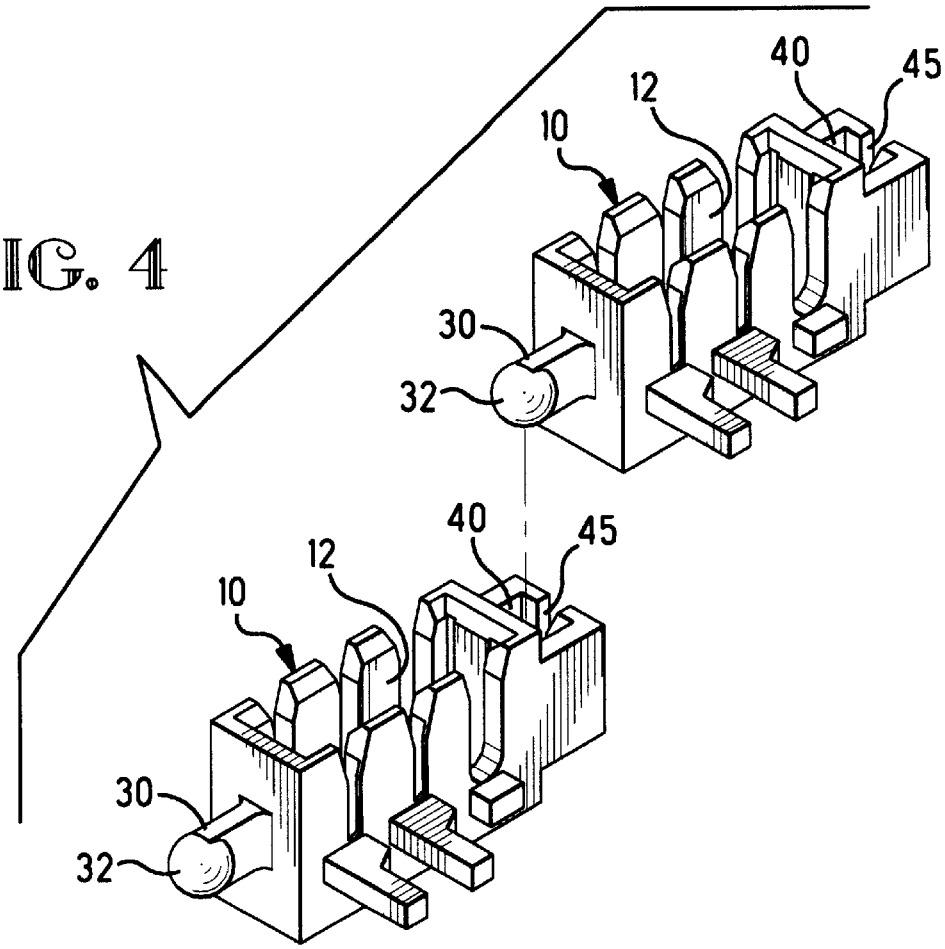
FIG. 4 is an isometric view of two terminal blocks which are poised to be linked together.
Figure 5:
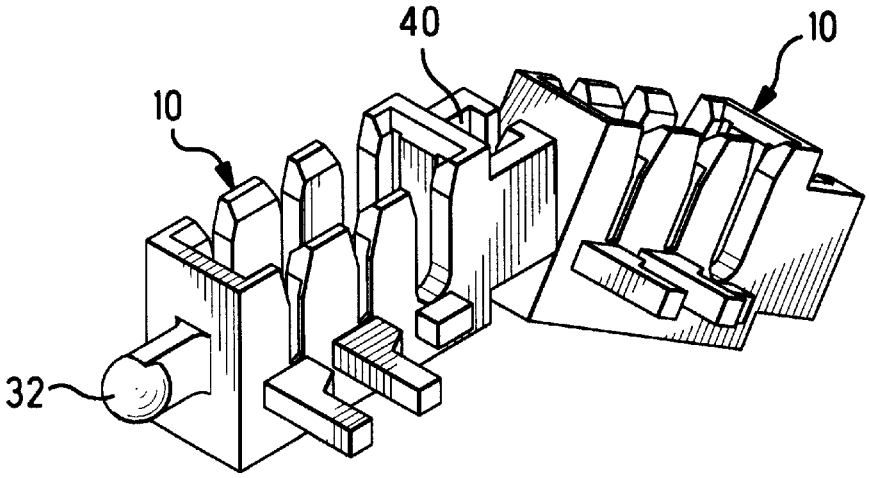
FIG. 5 is an isometric view of two terminal blocks which have been linked together.
Figure 6:
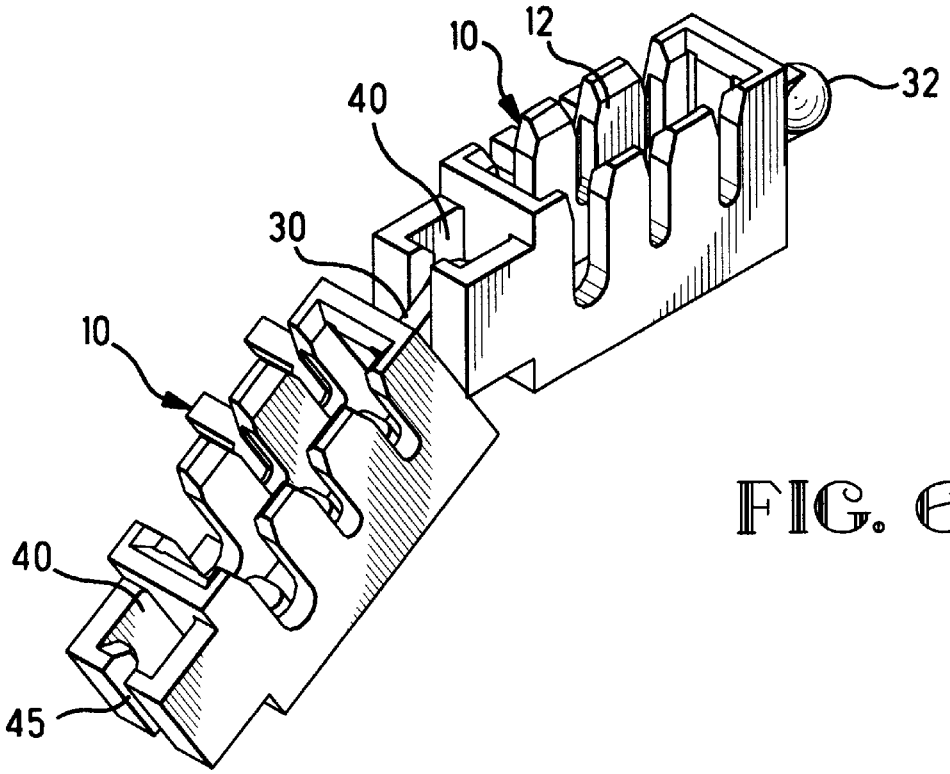
FIG. 6 is an isometric view of the linked terminal blocks from a different direction.

With reference to FIGS. 4–6, the socket 40 and the slot 45 can receive the ball 32 and the arm 30, respectively, of an identical terminal block 10. In this way, a plurality of terminal blocks can be linked together in a chain. The socket is dimensioned to permit rotation of the ball 32, but the slot 45 confines the arm 30 to pivoting substantially in a plane. A pair of terminal blocks which are linked together can be pivoted through an angle of approximately ninety degrees relative to each other, as shown by the terminal block in phantom lines in FIG. 7.

Figure 7:
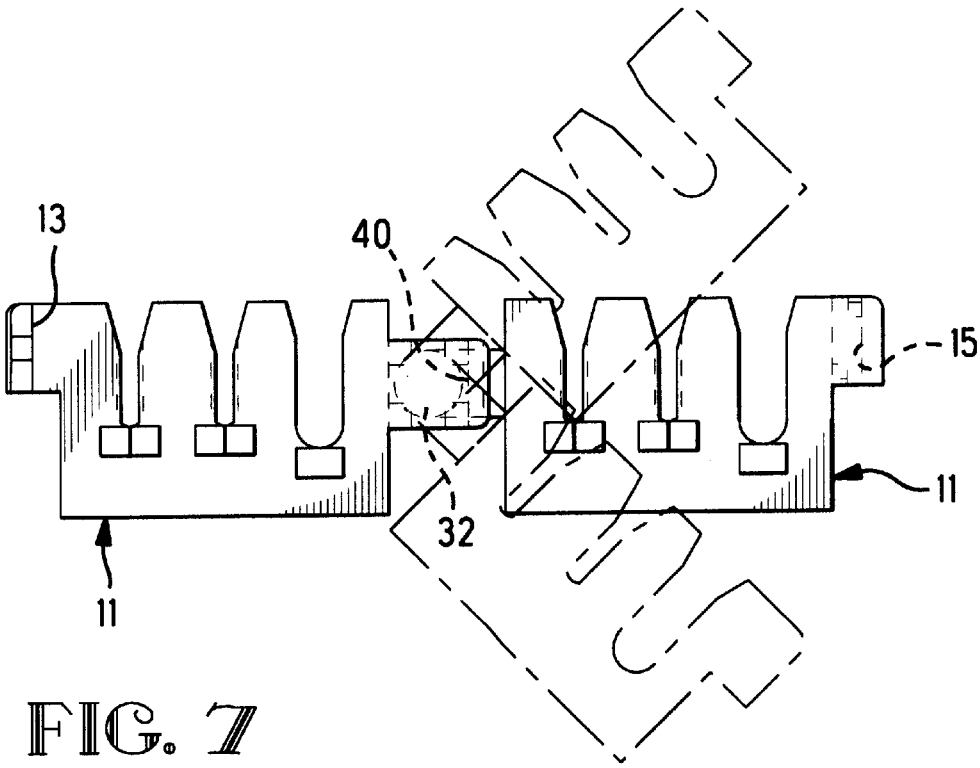
FIG. 7 is a side view of linked terminal blocks showing a pivoting range in phantom lines.

It should be noted that the terminal blocks shown in FIG. 7 are an alternate embodiment of the terminal block 10. Each of these terminal blocks 11 has an end that does not include either the ball 32 or the socket 40. Instead, one of these terminal blocks has an end with a rib 13 and the other of these terminal blocks has an end with a complementary groove 15. The rib and the groove permit attachment of these terminal blocks to other terminal blocks having a complementary rib or groove in a conventional manner.

Figure 8:
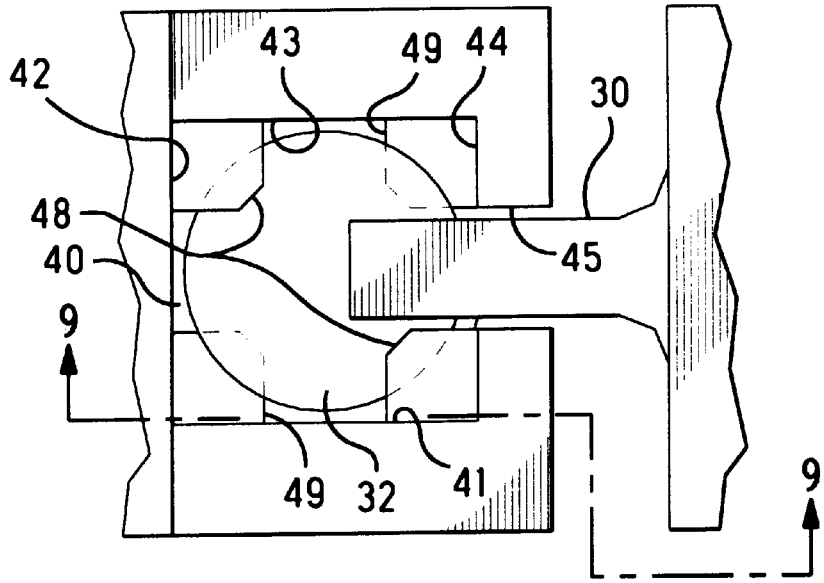
FIG. 8 is an enlarged top view of a ball and socket coupling which links two terminal blocks.
Figure 9:
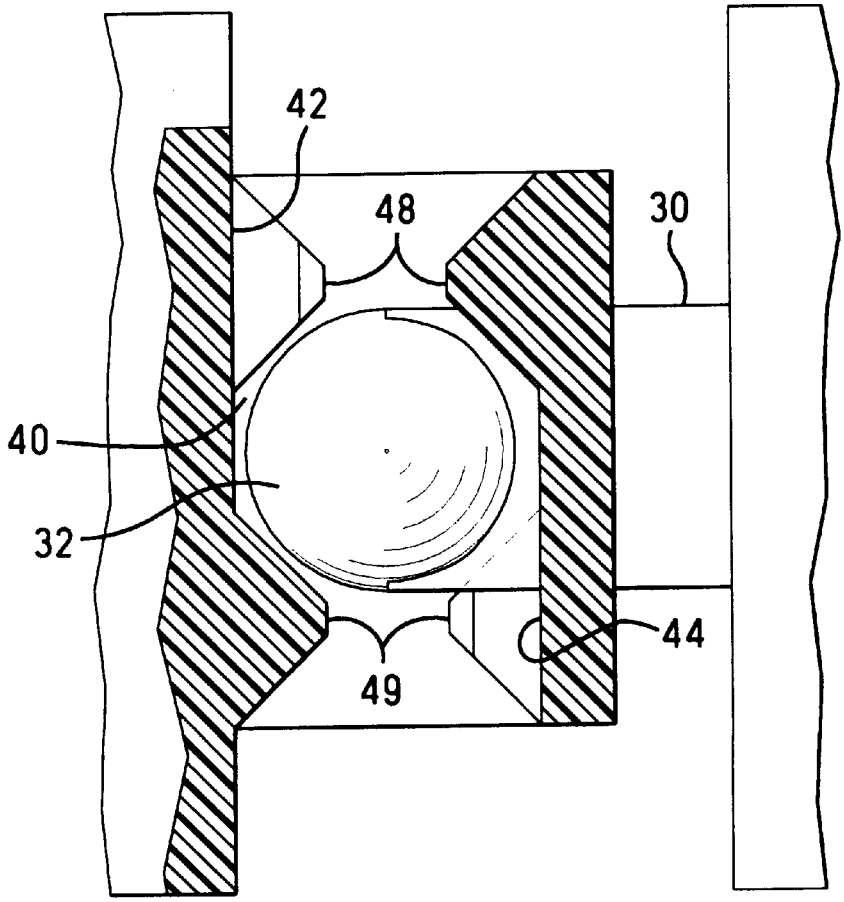
FIG. 9 is a side cross-sectional view of the ball and socket coupling taken along line 9—9 in FIG. 8.

With reference to FIGS. 8 and 9, the ball 32 can be inserted through either the open top or the open bottom of the socket 40, and the walls 41, 42, 43, 44 are shaped to retain the ball in the socket. This is accomplished by at least one upper projection 48 and one lower projection 49 which extend from one or more of the walls into the socket. In the illustrated embodiment, two upper projections 48 extend from the walls at diagonally opposite corners of the socket, and two lower projections 49 likewise extend from the walls at the other two diagonally opposite corners of the socket. However, the ball may be retained with only the one projection 48 which extends from a corner of the walls 41 and 44, and the one projection 49 which extends from a corner of the walls 43 and 44, as shown in FIG. 3. Due to the slot 45 which bifurcates the wall 44, the walls 41 and 43 are permitted to flex a small amount so that the ball can pass the projections 48, 49 during insertion of the ball into the socket. The ball becomes trapped between the upper and lower projections 48 and 49 which serve to resist pullout and inadvertent release of the ball from the socket.

Figure 10:
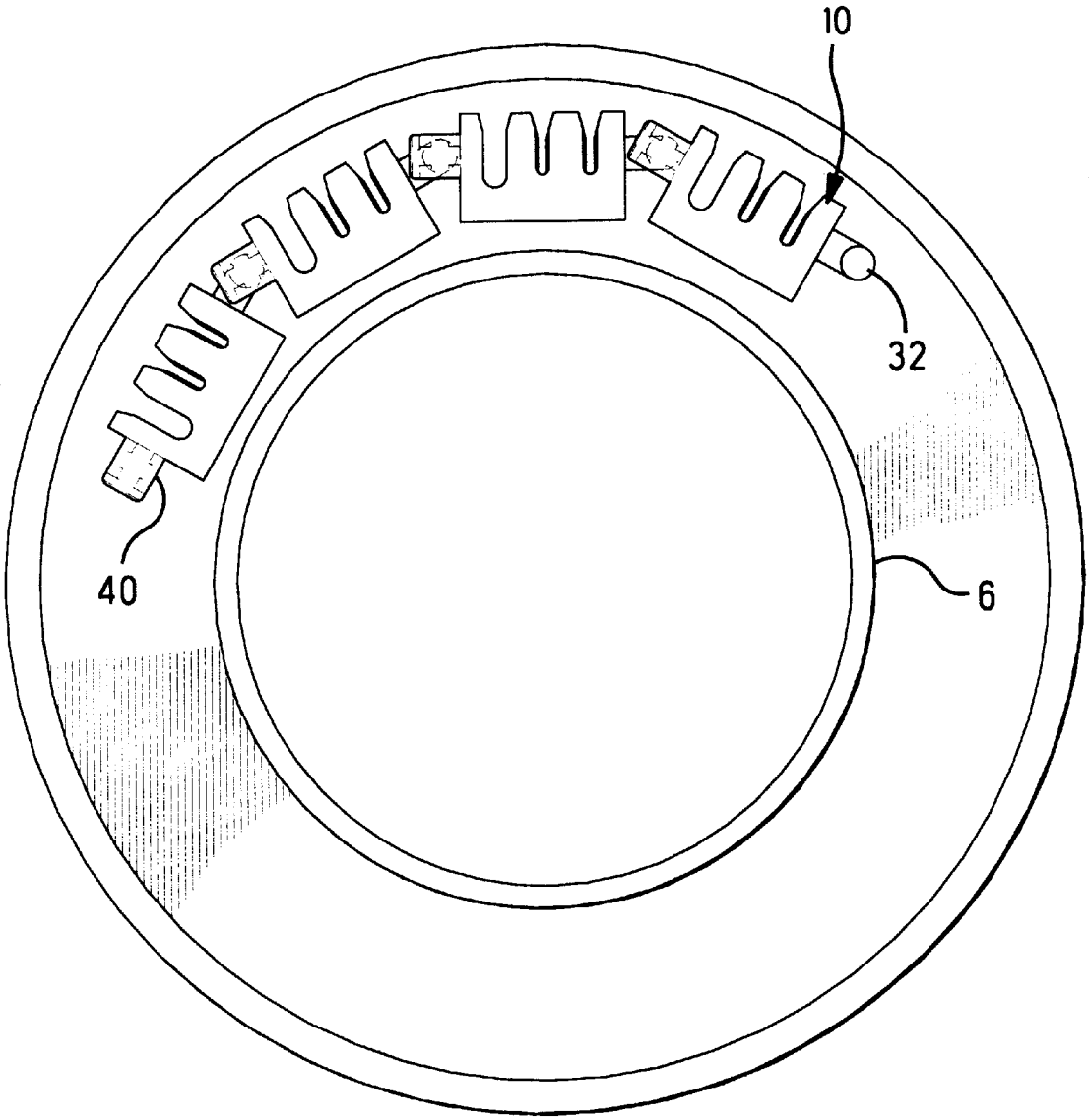
FIG. 10 is a representative view of a wire winding and a plurality of terminal blocks which are pivotally linked and disposed in an arc around the wire winding.

FIG. 10 shows how a plurality of the terminal blocks 10 which are linked together can be arranged in an arc to conform to the shape of wire windings 6 around a core of an electric motor. This flexibility permits the plurality of terminal blocks to be packaged in an envelope that closely surrounds the motor core. Therefore, a plurality of wires that are associated with the motor can be terminated in terminal blocks without a significant increase in external dimensions of the motor.

The invention provides electrical connectors which can be pivotally linked together. The pivoting linkage permits a plurality of linked connectors to be arranged in a curvilinear configuration. A particular advantage of the pivoting linkage is that multiple electrical connectors can be made to conform to the curved surface of a motor winding.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical connector comprising:

a terminal block having a first end being pivotally and removably attachable and reattachable to a first complementary end of a first associated terminal block.

2. The electrical connector of claim 1 wherein the terminal block has a second end being pivotally and removably attachable and reattachable to a second complementary end of a second associated terminal block.

3. The electrical connector of claim 2 wherein the first end is identical to the second complementary end and the second end is identical to the first complementary end.

4. The electrical connector of claim 3 wherein the first and second ends are configured as respective opposite ones of an interlockable ball and socket.

5. The electrical connector of claim 4 wherein the ball is disposed at a free end of an arm, the socket has an open top and is bounded by side walls, and one of the side walls has a slot which extends downwardly from the open top, wherein the slot receives the arm when the ball is installed in the socket.

6. The electrical connector of claim 5 wherein the socket has an open bottom and the slot extends upwardly from the open bottom to permit insertion of the ball into the socket through the open bottom.

7. The electrical connector of claim 6 wherein at least one upper projection and one lower projection extend from the side walls into the socket to resist pullout of the ball from the socket.

8. A group of electrical connectors comprising:

a plurality of terminal blocks each having a first end and a second end, the first end of any one of said terminal blocks being pivotally and removably attachable and reattachable to the second end of any other of said terminal blocks, wherein the plurality of terminal blocks may be pivotally linked together in a chain.

9. The group of electrical connectors according to claim 8 wherein the first and second ends are configured as respective opposite ones of an interlockable ball and socket.

10. The group of electrical connectors according to claim 9 wherein the ball is disposed at a free end of an arm, the socket has an open top and is bounded by side walls, and one of the side walls has a slot which extends downwardly from the open top, wherein the slot receives the arm when the ball is installed in the socket.

11. The group of electrical connectors according to claim 10 wherein the socket has an open bottom and the slot extends upwardly from the open bottom to permit insertion of the ball into the socket through the open bottom.

12. The group of electrical connectors according to claim 11 wherein at least one upper projection and one lower projection extend from the side walls into the socket to resist pullout of the ball from the socket.

* * * * *